US009162691B2

(12) United States Patent
Polivka et al.

(10) Patent No.: US 9,162,691 B2
(45) Date of Patent: Oct. 20, 2015

(54) SYSTEM AND METHOD FOR DETECTING BROKEN RAIL AND OCCUPIED TRACK FROM A RAILWAY VEHICLE

(71) Applicant: Transportation Technology Center, Inc., Pueblo, CO (US)

(72) Inventors: Alan Lee Polivka, Pueblo West, CO (US); Jerome J. Malone, Jr., Pueblo West, CO (US); Brian Eric Smith, Pueblo West, CO (US); Steven Mark Renfrow, Pueblo, CO (US)

(73) Assignee: Transportation Technology Center, Inc., Pueblo, CO (US)

( * ) Notice: Subject to any disclaimer, the term of this patent is extended or adjusted under 35 U.S.C. 154(b) by 156 days.

(21) Appl. No.: 13/869,227

(22) Filed: Apr. 24, 2013

(65) Prior Publication Data

US 2013/0284859 A1 Oct. 31, 2013

Related U.S. Application Data

(60) Provisional application No. 61/639,256, filed on Apr. 27, 2012.

(51) Int. Cl.
*B61L 1/18* (2006.01)
*B61L 27/00* (2006.01)
(Continued)

(52) U.S. Cl.
CPC ..... *B61L 27/0055* (2013.01); *B61L 1/188* (2013.01); *B61L 3/243* (2013.01); *B61L 23/044* (2013.01);
(Continued)

(58) Field of Classification Search
CPC ..... B61L 23/044; B61L 23/041; B61L 1/181; B61L 1/188
USPC ..... 246/34 R, 34 B, 120, 121, 122 R
See application file for complete search history.

(56) References Cited

U.S. PATENT DOCUMENTS 2,605,390 A 7/1952 Judge
3,038,066 A 6/1962 Barry
(Continued)

FOREIGN PATENT DOCUMENTS

GB 2208449 A * 3/1989 ..... B61L 1/18

OTHER PUBLICATIONS

Tsunashima et al., Condition Monitoring of Railway Track Using In-Service Vehicle, ISBN: 978-953-51-0451-3, Mar. 30, 2012, pp. 333-356, In Tech, available from: http://www.intechopen.com/books/reliability-and-safety-in-railway/condition-monitoring-or-railway-track-using-in-service-vehicle.
(Continued)

*Primary Examiner* — Zachary Kuhfuss
(74) *Attorney, Agent, or Firm* — Dorr, Carson & Birney, PC

(57) ABSTRACT

A method is provided for detecting broken rail, unintentionally misaligned turnouts, and track occupancy ahead of or behind a railway vehicle traveling on a railroad track. Shunts extend between the rails at intervals along the railroad track. Each shunt has electrical signal transmission characteristics differing from those of adjacent shunts. A test unit on the railway vehicle induces a test signal in a first rail to create a track circuit in which the test signal propagates along the first rail, through at least one of the shunts, returns to the railway vehicle along the second rail, and through the wheels and axle of the railway vehicle. The test signal has electrical properties selected to interact with at least one of the shunts. The received test signal on the second rail is analyzed to identify predetermined conditions concerning the status of the railroad track.

17 Claims, 13 Drawing Sheets

(51) Int. Cl.

| | |
|---|---|
| ***B61L 3/24*** | (2006.01) |
| ***B61L 23/04*** | (2006.01) |
| ***B61L 25/02*** | (2006.01) |
| *B61L 21/10* | (2006.01) |

(52) U.S. Cl.
CPC ..... *B61L 25/021* (2013.01); *B61L 25/026* (2013.01); *B61L 21/10* (2013.01); *B61L 25/023* (2013.01); *B61L 2205/04* (2013.01)

(56) References Cited

U.S. PATENT DOCUMENTS

| | | | | | |
|---|---|---|---|---|---|
| 3,696,243 | A | | 10/1972 | Risely | |
| 3,808,425 | A | | 4/1974 | Campbell et al. | |
| 3,946,972 | A | | 3/1976 | Grundy | |
| 3,986,691 | A | * | 10/1976 | Ehrlich et al. | 246/34 R |
| 4,053,128 | A | * | 10/1977 | Frielinghaus et al. | 246/34 R |
| 4,306,694 | A | * | 12/1981 | Kuhn | 246/125 |
| 4,373,691 | A | | 2/1983 | Fricke et al. | |
| 4,389,033 | A | | 6/1983 | Hardman | |
| 4,415,134 | A | | 11/1983 | Wilson | |
| 4,487,385 | A | * | 12/1984 | Salmon | 246/122 R |
| 4,728,063 | A | | 3/1988 | Petit et al. | |
| 4,886,226 | A | | 12/1989 | Frielinghaus | |
| 4,979,392 | A | | 12/1990 | Guinon | |
| 5,263,670 | A | | 11/1993 | Colbaugh et al. | |
| 5,330,134 | A | | 7/1994 | Ehrlich | |
| 5,331,288 | A | | 7/1994 | Darrow | |
| 5,358,202 | A | | 10/1994 | Tse et al. | |
| 5,398,894 | A | | 3/1995 | Pascoe | |
| 5,501,416 | A | | 3/1996 | Capan | |
| 5,501,417 | A | | 3/1996 | Capan | |
| 5,586,736 | A | | 12/1996 | Mollet | |
| 5,622,339 | A | | 4/1997 | Capan | |
| 5,628,478 | A | | 5/1997 | McConnel et al. | |
| 5,680,054 | A | | 10/1997 | Gauther | |
| 6,102,340 | A | | 8/2000 | Peek et al. | |
| 6,655,639 | B2 | | 12/2003 | Grappone | |
| 7,226,021 | B1 | | 6/2007 | Anderson et al. | |
| 7,295,017 | B2 | | 11/2007 | Fries | |
| 7,762,290 | B2 | | 7/2010 | Johnson | |
| 7,823,841 | B2 | | 11/2010 | Anderson et al. | |
| 7,954,770 | B2 | | 6/2011 | Tomlinson et al. | |
| 8,857,769 | B1 | * | 10/2014 | Hogan | 246/122 R |
| 8,914,171 | B2 | * | 12/2014 | Noffsinger et al. | 701/19 |
| 2003/0010872 | A1 | | 1/2003 | Lewin et al. | |
| 2003/0038216 | A1 | | 2/2003 | Holgate | |
| 2005/0076716 | A1 | | 4/2005 | Turner | |
| 2007/0132463 | A1 | | 6/2007 | Anderson | |
| 2008/0105791 | A1 | * | 5/2008 | Karg | 246/120 |
| 2008/0272245 | A1 | | 11/2008 | Mollet et al. | |
| 2013/0334373 | A1 | * | 12/2013 | Malone et al. | 246/2 R |
| 2014/0319285 | A1 | * | 10/2014 | Hogan | 246/122 R |
| 2014/0319286 | A1 | * | 10/2014 | Hogan | 246/122 R |
| 2014/0326835 | A1 | * | 11/2014 | Schwellnus et al. | 246/122 R |

OTHER PUBLICATIONS

PCT International Search Report and Written Opinion of the International Searching Authority for International Application No. PCT/US2013/038364, dated Aug. 15, 2013, 8 pages.

* cited by examiner

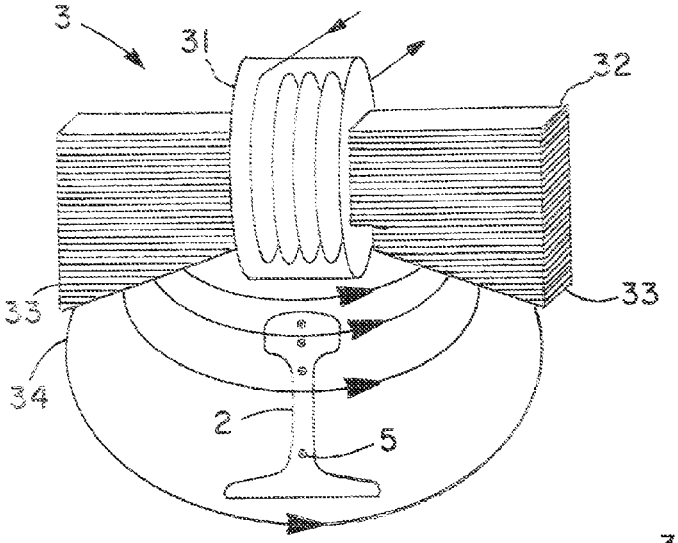
Fig. 3
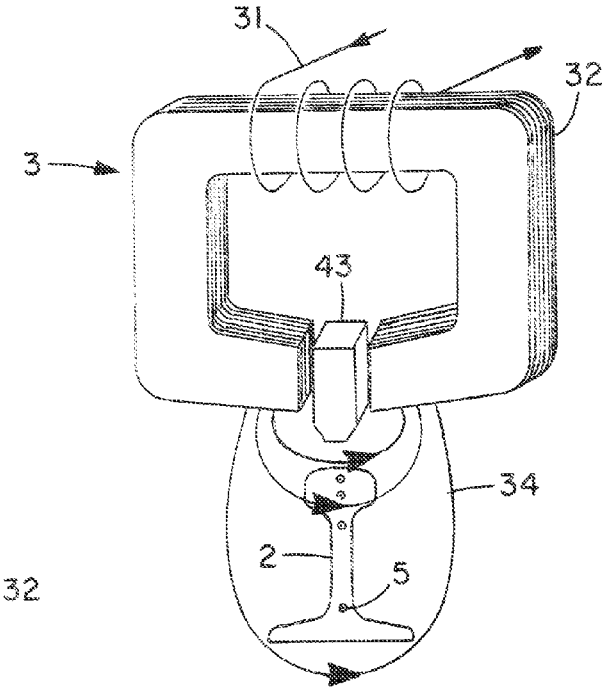
Fig. 4
Fig. 5
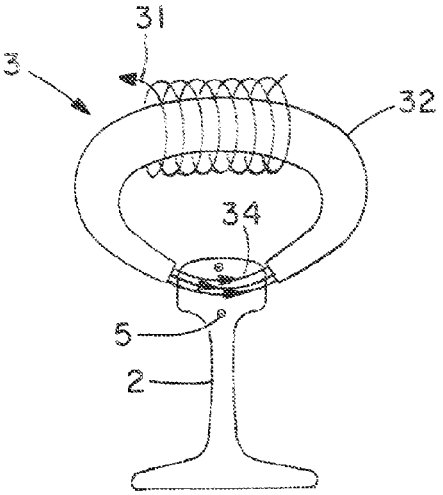

SYSTEM AND METHOD FOR DETECTING BROKEN RAIL AND OCCUPIED TRACK FROM A RAILWAY VEHICLE

RELATED APPLICATION

The present application is based on and claims priority to the Applicants' U.S. Provisional Patent Application 61/639,256, entitled "System and Method for Detecting Broken Rail and Occupied Track from a Railway Vehicle," filed on Apr. 27, 2012.

BACKGROUND OF THE INVENTION

1. Field of the Invention

The present invention relates generally to safety and efficiency of train movement. More particularly, the present invention is in the field of railroad signaling and train control, including positive train control (PTC), centralized traffic control (CTC), automatic block signaling (ABS), and communications-based train control (CBTC).

2. Background of the Invention

Rail breaks, unintentionally misaligned turnouts, and occupied track present potential hazards to moving trains. Traditionally, rail breaks, misaligned turnouts and occupied track are directly detected by use of track circuits. Railroad track is physically divided into electrically distinct blocks. An electrical current is caused to flow from a source located at the terminus of each block, through the rails, and is detected at both ends of the block, forming a track circuit.

Electrical current in a track circuit is detected by an electronic circuit or by use of an electromechanical relay. The presence of current in a track circuit indicates electrical continuity in the rails and thus the absence of broken rail. The absence of current indicates that either a broken rail or open switch is causing an electrical open circuit, or that the presence of a train is shunting current between the rails, causing a short circuit. In either case, the current will not be detected. Either condition indicates a potential hazard, and will cause the wayside or in-cab signaling system governing movement on the track to indicate a "stop" condition. Information that the block, or one of a group of blocks, is unavailable or occupied may also be communicated to a central train dispatching system.

A fundamental limitation of such traditional fixed-block wayside signaling systems is that by dividing railroad track into discrete blocks, they impose a limit on how closely trains can approach each other and still sense both broken rail and occupied territory ahead; thus they artificially limit maximum traffic density and therefore fundamentally restrict how efficiently a given track can be utilized. It therefore would be highly desirable to have a true "moving-block" or "virtual block" signaling system, whereby moving locomotives would have the ability to detect rail breaks or occupied track ahead of (or behind) their current positions, rather than being dependent on traditional fixed-block track circuits for rail break, open switch, and track occupancy detection.

A second fundamental limitation of traditional fixed-block track circuit systems is their inherent inability to detect a rail break which occurs ahead of or behind a moving train within the same block as the train. Also undetectable with track circuits is a rail break between two trains in the same block. In a traditional fixed-block track circuit, the loss of current from one end of the block to the other, caused by (intended) track occupancy is indistinguishable from the loss of current caused by a broken rail. It would be highly desirable not to lose the ability to detect broken rail when a block is occupied.

A third fundamental limitation of traditional track circuits is that they require installation of considerable track infrastructure, such as insulated joints between blocks, bond wires to ensure continuity between rail sections, wayside power, and wayside relay-based, code-relay, or (more commonly) electronic systems. This infrastructure and equipment is costly to install and requires very significant ongoing maintenance. It would be highly desirable to reduce these costs and simplify the track structure.

A fourth fundamental limitation of traditional track circuits is that they are not usually optimized to detect rail breaks, but instead are optimized for wayside signal system operation. It would be desirable to have better wayside detection of broken rails to improve train safety.

The present invention overcomes these fundamental limitations by eliminating the need for traditional, fixed-block track circuits for rail break detection, open switch detection, and track occupancy. By using equipment affixed to the leading or trailing locomotive(s) or cars of a train, in conjunction with passive (or active) shunts installed in the railroad track bed, and eliminating expensive wayside track circuit apparatus and associated track components used in traditional track circuits, the present invention reduces considerably both the track infrastructure cost and ongoing maintenance costs needed to detect broken rail and track occupancy.

Further, the present invention can be implemented in such a way so as not to be incompatible with existing traditional track circuit-based block signaling systems; it will not interfere with track circuits and wayside signal systems, if encountered, thus serving as an additional broken rail detection system capable of working in tandem with, and further, allowing existing traditional fixed-block systems to be optimized for broken rail detection.

A limitation of some implementations of PTC or CBTC systems that employ GPS data to determine which track a train is travelling on in multiple track territory is that even the best available GPS systems are unable to reliably distinguish which of two adjacent tracks a train is occupying with sufficient accuracy to be considered certain for safety-critical applications. An embodiment of the present invention solves this problem by providing the PTC system with a continuous, positive, unambiguous indication of which track the train is travelling on. This is a great advantage for practical implementation of a PTC system.

When used in conjunction with a route database or GPS location data, the present invention is capable of providing an additional method of estimating of train position, which can be optimally combined with GPS or other location system data or can be supplied to the CBTC/PTC system. The present invention is also able to detect rail breaks and track occupancies for a distance ahead of (or behind, if the system is mounted on the rear of the train) a moving train, enabling an improved implementation of CBTC/PTC.

SUMMARY OF THE INVENTION

The present invention is a system and method for detecting rail breaks or track occupancy from a railroad locomotive or rolling stock which may be moving or at rest, rather than by use of traditional fixed-block track circuits or track-mounted sensors. Certain embodiments of the present invention, when used in conjunction with a route database, GPS data or other location data, can provide a better estimate of train location information, including positive identification of which track a train is currently travelling on.

In one embodiment, the present invention uses a series of passive, tuned shunts electrically connected between the rails.

The shunts are placed in the track in such a manner that they alternate in their electrical signal transmission characteristics (e.g., their pass band frequency, or their notch band) so that no two adjacent shunts share the same frequency. A transmitting coil, mounted on the locomotive (or other railroad car), induces a swept sinusoidal current in one or both rails that flows longitudinally in both rails, through at least one of the nearest shunts located ahead of the train, and back to its source through locomotive and/or rolling stock axles located behind the transmit coil, thus forming a "track circuit" (different in form and function than a traditional fixed-block track circuit as described previously). The test signal induced in the tuned-shunt track circuit by the transmitting coil may be of swept frequency, may alternate between multiple fixed frequencies, have multiple simultaneous frequencies, be pulsed, or consist of high-amplitude (e.g., pseudo-random noise). A receiving coil (or other magnetic or electromagnetic field sensor) on the railway vehicle is used to detect the presence or absence of a test signal in the track. More than two different tuned frequencies can be used.

The received signal is then filtered, processed, and analyzed. Its frequency spectrum is examined. Absence of spectral energy at all transmitted frequencies (including frequencies near the frequencies of the tuned shunts) indicates a lack of continuity (open circuit) in the tuned-shunt track circuit. Conductivity at substantially all transmitted frequencies indicates a shunt (short circuit) caused by a track occupancy in the track circuit. Either of these two conditions will trigger a stop condition.

Under normal conditions, where neither a rail break nor a track occupancy is immediately present, spectral energy at or close to both shunt frequencies (but not at other frequencies) will be observed with their amplitudes in proportion to the relative distances from the train to the tuned shunts. This indicates continuity in the present and successive track circuit and no occupation thereof. Absence of spectral energy from one of the shunts but not the other shunt indicates a broken on rail on the next (successive) tuned-shunt block (of the missing frequency). At relatively long distances, the frequencies of the spectral peaks will differ from the nominal frequencies of the shunts because distributed reactance in the track will lower the shunt frequencies. Independent estimations of the locomotive's position in relation to the upcoming tuned shunts can be calculated from the relative magnitudes of the spectral peaks and from the frequency shifts of the spectral peaks relative to their nominal values.

Thus, the level of noise floor in the spectrum of the received signal indicates the presence of a track occupancy and the relative distance to it (assuming a constant rail resistivity or a known distribution of rail resistivities). Broadband conductivity indicates occupancy. The presence of, and relative magnitudes of, the spectral peaks at or close to the nominal shunt frequencies indicates the absence of broken rail.

A combination of these conditions, i.e., an elevated noise floor with distinct (but possibly broadened) spectral peaks, for example, indicates the absence of rail breaks and a distant track occupancy. The distance to the occupancy relative to the tuned shunts may be calculated if the electrical resistance and reactance of the track are known.

In other embodiments of the present invention, shunts of more than two tuned frequencies may be used, allowing the system to distinguish rail breaks or track occupancies in other track circuit blocks. Distinct nominal shunt frequencies may be used on adjacent tracks in multiple-track territory to definitively indicate to the system which track the vehicle is travelling on. Another variation is for each of the tuned shunts to exhibit a characteristic notch, rather than a peak in their frequency spectrum.

In other embodiments, the present invention may be used with track or wayside transponders, a route database, a wheel tachometer/odometer, gyroscopes, a GPS receiver, or other systems used to perform inertial or satellite-based navigation such that computer control can be used to reference positions of upcoming tuned shunts in the track, and thus to have prior knowledge of their expected magnitudes, frequency shifts, or phase shift relative to the transmitted signal. A Kalman filter, particle filter, or similar algorithm, may be included in the system to combine these various inputs and provide an optimal estimate of train location and speed for communication to a PTC system. The present invention can interface with, or be an integral part of CBTC or PTC systems, thereby obtaining such information from these systems and reporting the presence or absence of rail break or track occupancy to such systems, as well as providing an estimate of train location relative to tuned track shunts to the PTC system. When a rail break or track occupancy is detected, the present invention is capable of notifying the locomotive operator or triggering a brake application, and/or notifying the CBTC/PTC system.

The present invention overcomes several fundamental limitations of traditional fixed-block track circuit broken rail detection, including the inherent limit on train separation and track utilization efficiency.

The present invention is able to detect rail breaks occurring in real time immediately ahead of (or behind, if a system is mounted on the rear of the train) a moving train, a capability not performed by current fixed-block wayside signal systems, which lose the ability to detect a rail break once the block is occupied.

Embodiments of the present invention are not incompatible with existing traditional track circuit-based block signaling systems, particularly when implemented as an integral part of a PTC system where train and traffic control functions may be handled by radio communications rather than track circuits and wayside signals. Thus, in one embodiment, the present invention will allow existing traditional track-circuit based signaling infrastructure to be optimized for rail break detection rather than signaling. In another embodiment, the present invention can be used on trains that operate both on territories which have track circuits and those which do not, without concern of interfering with traditional track circuits, where present.

The present invention reduces considerably both the required track infrastructure and ongoing maintenance costs needed to detect broken rail, turnout positions, and track occupancy, while offering operational performance advantages.

BRIEF DESCRIPTION OF THE DRAWINGS

The present invention can be more readily understood in conjunction with the accompanying drawings, in which:

FIG. 3 is an illustration showing a possible form of a component used in the present invention, a transmit/receive coil arrangement used to induce a current in the rail.

FIG. 4 is an illustration of a second possible form of a transmit/receive coil, where the coil's core is bent so as to concentrate the magnetic field external to the core. The coil is equipped with a non-magnetic but conducting metal insert at the gap.

FIG. 5 is an illustration of a third possible form of a transmit/receive coil, where the coil's core is bent so as to concentrate the magnetic field extending from the core, and where the core is held in close proximity to the rail cross-section, causing the rail to partially complete the magnetic circuit in the core.

DETAILED DESCRIPTION OF THE INVENTION

Figure 1:
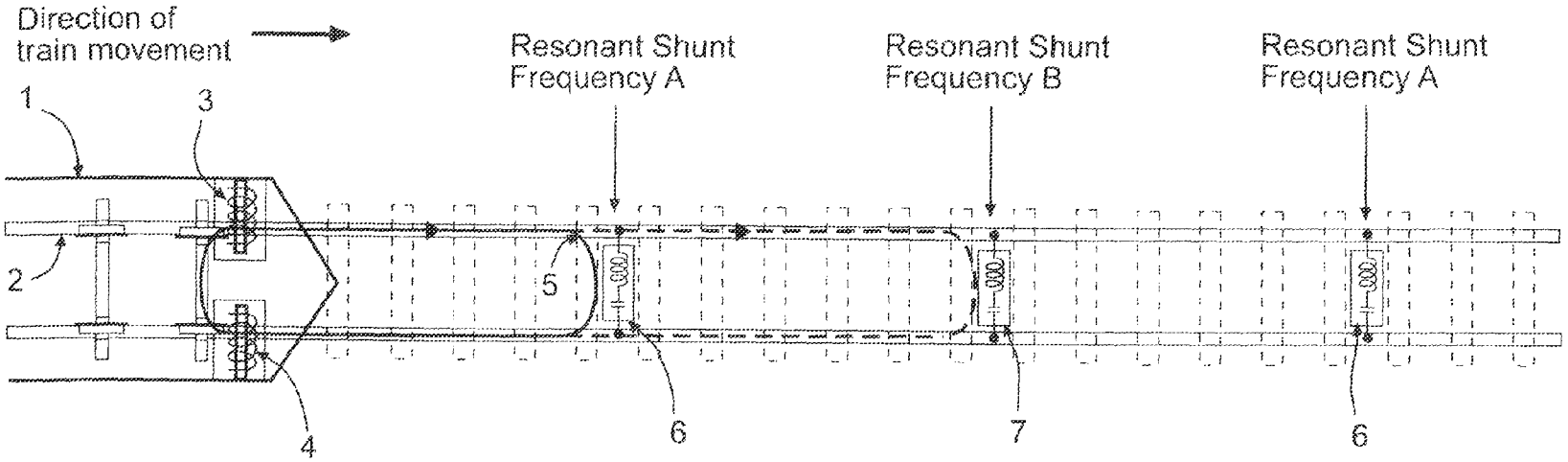
FIG. 1 is a pictorial diagram showing a locomotive traveling on a track, where the locomotive shown is equipped with an embodiment of the present invention and a series of passive, tuned shunts of alternate frequencies has been installed in the track. The current induced in the track by the present invention is shown in the figure.

Before describing in detail the system and method for detecting broken rail or occupied track from a moving locomotive, it should be observed that the present invention resides primarily in what is effectively a novel combination of conventional electronic circuits, electronic components, and signal processing/estimation algorithms, and not in the particular detailed configurations thereof. Accordingly, the structure, control, and arrangement of these conventional circuits, components, and algorithms have been illustrated in the drawings by readily understandable block diagrams which show only those specific details that are pertinent to the present invention, so as not to obscure the disclosure with structural details which will be readily apparent to those skilled in the art having the benefit of the description herein. Thus, the block diagram illustrations of the figures do not necessarily represent the mechanical structural arrangement of the exemplary system, but are primarily intended to illustrate the major structural components of the system in a convenient functional grouping, whereby the present invention may be more readily understood.

With reference now to FIG. 1, there is shown a pictorial diagram illustrating a locomotive 1 traveling on a track 2. For the purposes of this disclosure, the terms "locomotive" and "railway vehicle" should be broadly construed to include all types of locomotives, railroad cars and other tracked vehicles. The locomotive 1 is equipped with a test unit having transmit coils 3 and receive coils 4 located in front of the leading axle and suspended above each rail. A test signal is transmitted by the transmit coil 3 inductively coupled to one of the track rails, and the test signal is received by the receive coil 4 inductively coupled to the other of the track rails. In other words, the magnetic field surrounding the transmit coil 3 induces a test signal in a portion of the track 2. The circuit carrying the test signal consists of a segment of each rail, the axles behind the transmit coil 3, and several frequency-selective tuned shunts 6, 7 electrically connected between the rails of the track 2. In the embodiment illustrated in the figure, the shunts are tuned to one of two frequencies, here labeled frequency "A" 6 or frequency "B" 7. Shunts 6, 7 complete the track circuit current loop induced by the transmit coil 3. Only current at frequencies "A" and "B" will flow in the loops indicated, and will flow only if the rail is electrically continuous and not shunted (short-circuited) by another train occupying the region of track between the vehicle and the shunts, and the current will flow only if the circuit is not left in an open (non-conducting) condition by a broken rail or open switch.

Alternatively, relay-operated devices may be substituted in some embodiments for the tuned shunts 6, 7. When activated by a predetermined test signal (e.g., that is rectified and filtered at the device) induced in the track by a transmit coil 3, these relay-operated devices cause the rails to change between an electrically shunted state and an open state for a characteristic period of time. For example, device can be triggered to change from an open state to a shunted state for a characteristic period of time. This state change results in a change in the track current that is sensed by the receive coil 4, and can be used to identify specific shunts by their electrical signal transmission characteristics. The relay-operated devices can be configured to alternate between a shunted state and an open state for characteristic periods of time to create a characteristic pattern of states for each device, or at a characteristic rate or frequency for each device. For the purposes of this disclosure, the term "shunt" should be construed to include such relay-operated devices.

Figure 2:
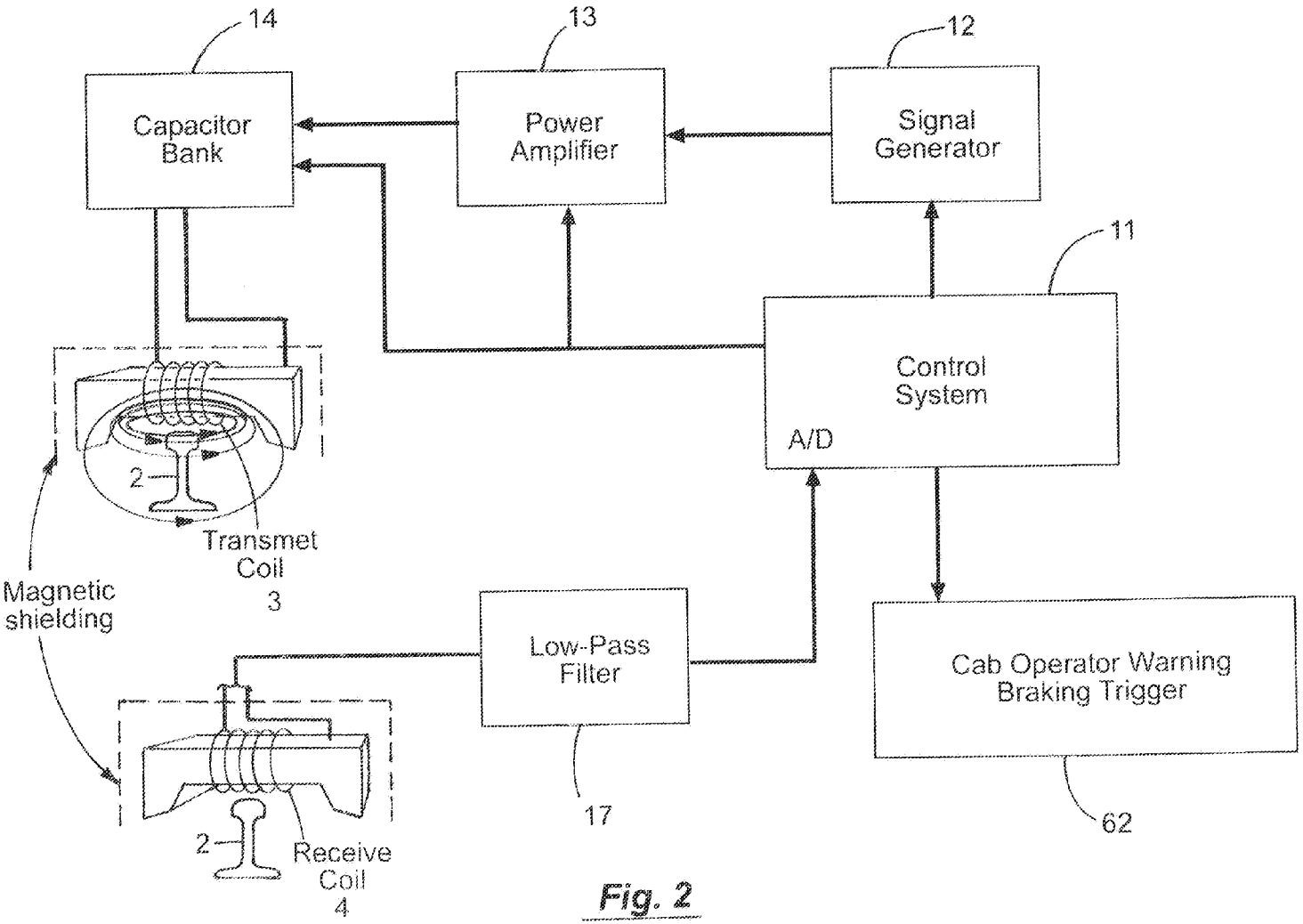
FIG. 2 is a block diagram of a system and method in accordance with a fundamental embodiment of the present invention for detecting broken rail and occupied track from a moving locomotive and implementing a true "moving block" train control system.

Referring now to the invention in greater detail, with reference to FIG. 2, there is shown a block diagram of an embodiment of an invention, in which a control system computer (e.g., processor) 11 equipped with an analog-to-digital (A/D) converter and/or various digital communications capabilities, which controls an oscillator/modulator unit 12, which generates a sinusoidal signal, either swept over a frequency range determined by, and at a sweep rate determined by, the control computer 11, or is switched between several discrete sinusoidal frequencies, or that simultaneously transmits signals of multiple sinusoidal frequencies, or that transmits a (band-limited) noise signal in the frequency range of interest, again determined by the control computer 11. In some embodiments, the processor may directly synthesize the signal itself with a digital-to-analog converter (D/A converter), rather than by means of the external oscillator/modulator 12 shown in this figure. In some embodiments, the sinusoidal signal may be modulated by (possibly orthogonal) low-frequency waveforms or digital signals. The output of the oscillator/modulator 12 is fed to a power amplifier 13, which produces a high-current output fed to the transmit coil 3, possibly via a capacitor bank 14. In some embodiments, the transmitted sinusoidal signal may be switched on and off periodically, allowing short-duration, high current pulses into the transmit coil 3, creating magnetic fields of high intensity. The control computer 11 may communicate with the power amplifier 13, specifying its power setting, and possibly receiving diagnostic information. The control computer 11 may also communicate with a capacitor bank 14, specifying capacitance values to be switched across the transmit coil 3 inductance, thereby tuning the resultant LC circuit to approximately match the transmitted frequency or possibly the resonant frequency of the track 2, thereby maximizing coupling of transmitted signal energy from the transmit coil 3 to the track circuit, and may, in some embodiments, employ feedback from the receive coil 4 to do so.

With continued reference to FIG. 2, there is shown a control system computer (processor) 11 equipped with an analog-to-digital converter capable of reading the received test signal from a receive coil 4 or other similar magnetic-field or current-sensing receiving device, possibly connected through a low-pass or band pass filter arrangement 7. Alternatively, analog means could be used to detect the received test signal in the coil and compute its spectrum. The control system computer 11 is capable of analyzing the signal obtained from the receive coil 4, using an FFT or similar algorithm, to determine the amplitudes, frequencies, phases, and/or modulating waveforms of the received signal. An algorithm is used to analyze the received test signal to detect the presence or absence of current in the track circuit conducted close to or at a particular tuned shunt frequency, indicating a broken rail or an occupied track ahead of the railway vehicle, or a clear block. Further, an estimation algorithm is implemented in the control system computer 11 consisting of a Kalman filter, particle filter or similar estimation algorithm to optimally combine data from the detection algorithm with location or route information from other systems (i.e., a route database, GPS, etc.), if present, to optimally estimate the vehicle's location and speed relative to the tuned shunts.

With reference now to FIG. 3, the transmit coil 3 is shown in this illustration in greater detail. Many turns of heavy gauge, high-ampacity wire form the coil windings 31, and carry a substantial current around a laminated, high-permeability core 32. Similar material is used to form extensions to the coil core 33, which direct a portion of the coil's magnetic field 34 downward and around the railroad rail 2 cross-section. The perpendicular component of the magnetic field 34 in three-dimensional space creates an alternating magnetic flux that surrounds the rail 2, or cuts through and encircles a substantial area of the rail 2 cross-section, to induce a longitudinal (i.e., into/out of the page) current 5 in the rail. Because of the skin effect, the induced current 5 will become uniform on the surface of the rail 2 cross-section over a very short longitudinal distance, causing a current to flow in any circuit formed by the rails 2, the axles/wheels of the locomotive 1, and any equipment on the track ahead of the locomotive 1 that shunts the rails 2, including frequency-selective tuned shunts 6, 7.

With continued reference to FIG. 3, in some embodiments, similar coil designs can be used for the receive coils 4, with the exception that the windings consist of many hundreds of turns of low-current wire rather than substantially fewer high current turns. The receive coil 4 or transmit coil 3 is equipped with magnetic shielding such that the receive coil 4 is substantially immune to direct magnetic coupling from the transmit coil 3 and sources of unwanted interference, but is sensitive to current flowing in the rail track circuit. In other embodiments, a Hall Effect sensor may be instead of or in addition to the receive coil 4 to detect current flowing in the track circuit.

In another embodiment, a transmit coil 3 similar to that illustrated in FIG. 4 is employed, where the coil's core is now bent in a mostly-closed loop so as to concentrate the magnetic field at the gap, and similarly create a magnetic field 34 surrounding or encircling part of the rail 2 cross-section. A portion of the magnetic field will penetrate and encircle a portion of the rail head where the rail section acts to complete partially the magnetic circuit, inducing a current distribution 5 in the rail head. A non-magnetic metallic conducting insert 43, typically made of brass or aluminum alloy, may be further used to shape the magnetic field 34 so that a portion of it will surround or cut through a portion of the rail 2 cross-section. Other magnetic arrangements and coil configurations are possible. In some embodiments, both the transmit and receive coils operate in pairs, with one pair above each rail, connected so as to reduce the risk of common-mode interference.

In yet another embodiment, a transmit coil similar to that shown in FIG. 5 is employed, where current flows in the coil's core 32. The core 32 is bent so as to concentrate the magnetic field 34 at the gap between the core 32 and rail 2, and where the rail 2 cross-section is placed as closely as possible to the coil's core 32 as practical clearance limits will allow, in such a manner that the rail 2 section completes the magnetic circuit in the coil's core 32, inducing a longitudinal current 5 in the portion of the rail 2 cross-section cut by the alternating magnetic field, and rapidly spreading to the surface of the rail cross-section to become uniform a short distance from the coil.

Figure 6:
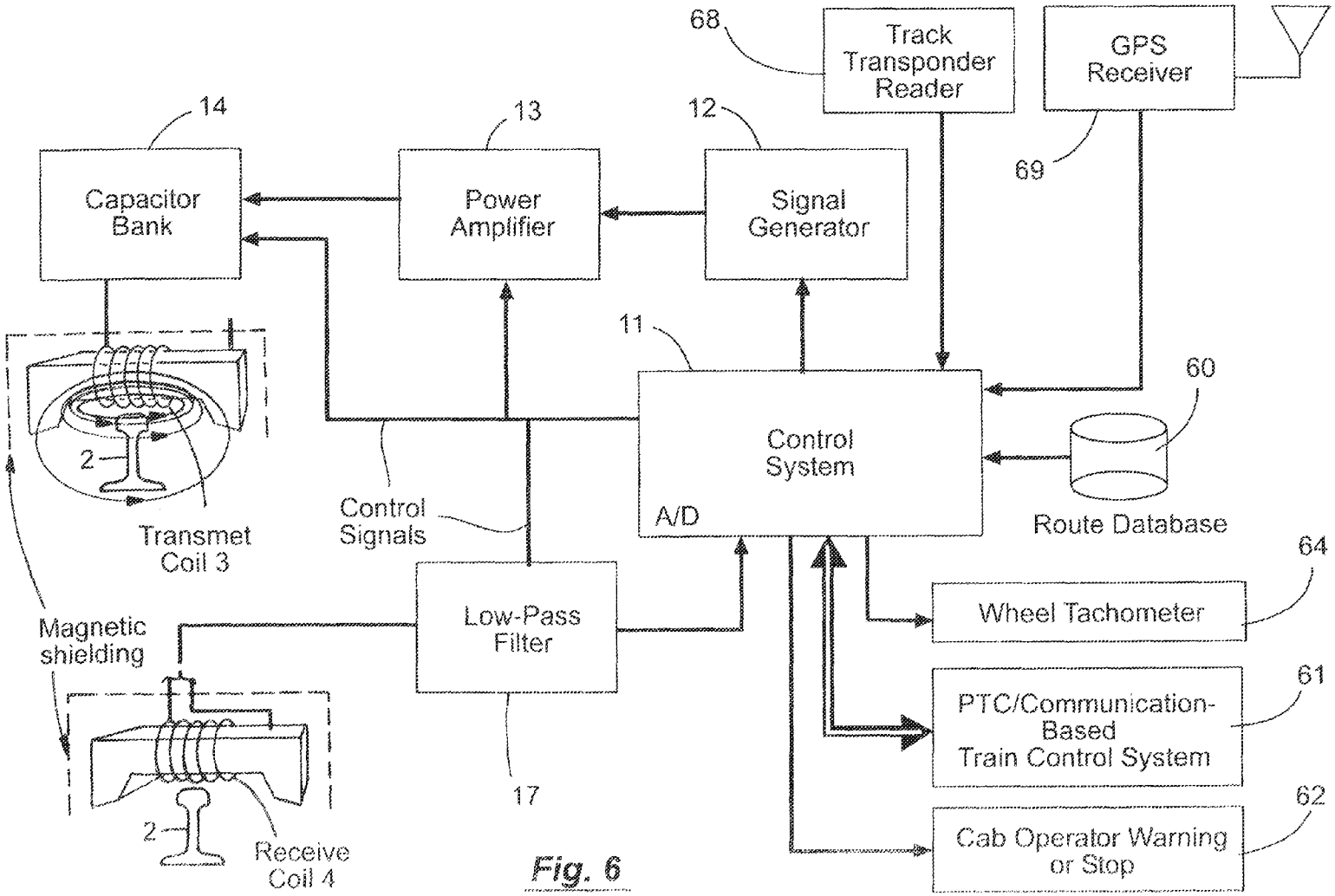
FIG. 6 is a block diagram of an embodiment of the present invention that is closely integrated with devices providing external position information, such as global positioning system (GPS) data, track transponder data, tachometer data, PTC or CBTC data, cab signal data, or other train control, position or location data which are incorporated into the system to enhance performance, including data used in implementing a true "moving block" PTC system.

Referring now to the invention in greater detail, with reference to FIG. 6, in some embodiments, a route database 60 containing coordinates of the track shunts 6, 7 and their specific resonant frequencies, as well as locations of track work that may affect tuned shunt functionality, locations of wayside signals and track transponders, characteristic track impedance parameters, insulated joints (if present) and other pertinent track data useful for the system to predict and interpret variations in amplitude, frequency, and phase of the received signal, is accessible to the control system computer 11. The route database 60 may be uploaded or updated for at least the route to be traveled, by the PTC system 61, before travel begins. In some embodiments, similar information, as well as actual location information obtained from the PTC system 61, cab signal system 62, and wheel tachometer 64, will be provided to the system and combined to obtain an optimal estimation of location in relation to shunt placement and track conditions, and determine expected shunt frequencies and phase relations.

Referring now to the invention in greater detail, with continued reference to FIG. 6, there is shown a system very similar to that illustrated in FIG. 2 except that now the control system computer 11, is also equipped with various digital communications capabilities allowing it to exchange information with a GPS system 69, a route database 60, a PTC/communications-based train control system 61, a cab signal system 62 or other train control, position, and location systems, a wheel tachometer 64 or other systems. The route database 60 containing coordinates of track shunts 6, 7 and their tuned frequencies, as well as track work that may obstruct tuned shunt functionality, common track work, location of wayside signals and track transponders, track impedance characteristic parameters, insulated joints (if present) and other pertinent track data needed for the system to interpret variations in the received signal is accessible to the control system computer 11. The route database 60 may be uploaded and updated for at least the route to be traveled by the PTC system 61 before travel begins. A Kalman filter, particle filter, or similar algorithm may be included in the control system computer to optimally combine inputs from the detection algorithm and information from the database and other systems to optimally estimate train location and speed.

With continued reference now to FIG. 6, there is shown a transmit coil 3 mounted to the leading (or trailing) end of a locomotive 1 in a position forward of the first set of railroad axles, and as close to the rail 2 as clearance standards will allow. Various forms and shapes of transmit coil 3 were illustrated and discussed with reference to FIGS. 3-5.

With reference now again to FIG. 6, there is shown a receiving coil 4 which is similarly mounted forward of the locomotive's axles and wheels, but placed in such a position as to minimize direct magnetic coupling with the transmit coil 3 and also to minimize stray magnetic coupling from interference sources such as traction motors, generators, etc., on the locomotive and on the wayside. Additionally, either or both coils 3, 4 may also be equipped with magnetic shielding so as to reduce such direct coupling. The receiving coil 4 differs from the transmit coil 3 in that it has windings consisting of many turns of fine wire, but the core may take many forms, such as those illustrated in FIGS. 3-5, or may take an entirely different form, such as a Hall Effect sensor or toroid (current transformer) placed around a locomotive axle. In some embodiments, the receive coil 4 is connected to a tunable analog band pass filter 17 or switchable capacitor bank that is controlled by the control system computer 11. The control system computer 11 samples the received signal using an A/D converter, and computes the frequency spectrum of the received signal.

The control system computer 11 is programmed with software that continuously controls and adjusts the transmitted frequency, rate of frequency sweep, transmit coil current, and resonant tuning of the transmit and receive coils 3, 4 possibly by selecting capacitors from a capacitor bank 14. The control system computer 11 simultaneously reads and analyzes the frequency and phase content of the signal induced in the receive coil 4 by the current flowing in the track circuit. The control system computer 11 computes the frequency spectrum of the received signal. In some embodiments, the invention is equipped with the ability to receive GPS data from a GPS receiver 69 or read track-mounted transponders 68 or have access to a route database 60. In these embodiments, and other embodiments where the present invention is used with a PTC system 61, the control computer 11 may have the ability to communicate directly with these respective systems. In some embodiments, the present invention may also interface directly with a cab signal system 62, which itself may be part of a CBTC or PTC system 61. The control computer 11 has the ability to trigger a stop of the train or indicate to the locomotive operator or train control system that it has detected a broken rail or track occupancy.

Figure 7:
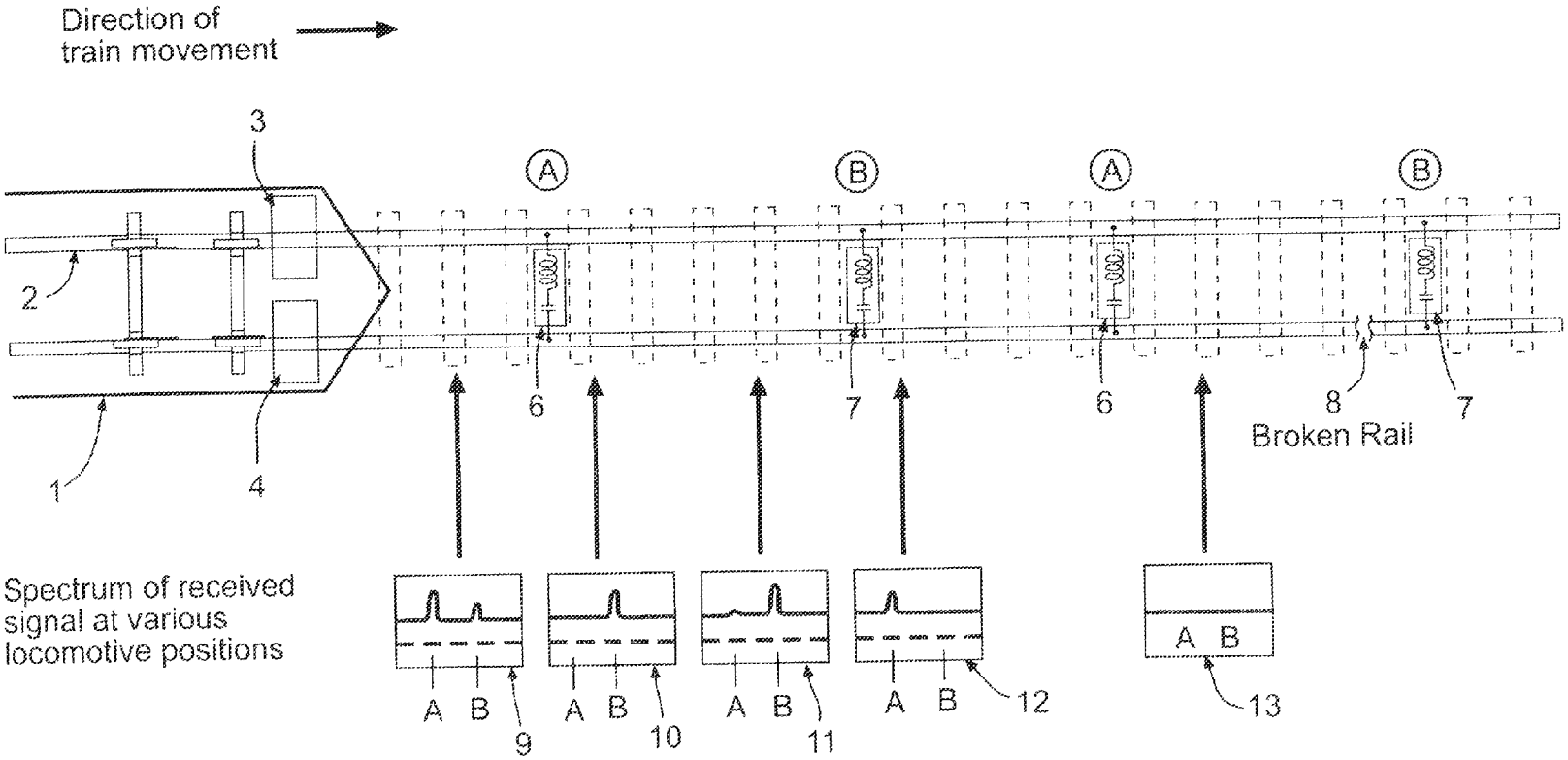
FIG. 7 is a pictorial diagram showing a locomotive traveling on a track, as in FIG. 1, with the corresponding spectrum of the received signal illustrated at various points in relation to the shunts in the track. A broken rail and the effect it has on the spectrum are also shown in this figure.

With reference to FIG. 7, there is shown a pictorial diagram illustrating a locomotive 1 traveling on a track 2 (similar to the arrangement initially shown in FIG. 1). In this figure, alternating tuned shunts 6, 7 are shown installed in the track, while the frequency spectra 9, 10, 11, 12, 13 of the signal obtained from the receive coil 4 is shown at various points along the track as the locomotive 1 passes those points. Because the tuned shunts 6, 7 act to selectively conduct at specific frequencies, the magnitude of the spectral components of the received signal in 9, 10, 11, 12, 13 will vary in inverse proportion to distance to the shunts 6, 7, if no broken rail 8 or track occupancy is present. When shunts of frequency "A" 6 and frequency "B" 7 are found in front of the train, peaks close to these nominal frequencies will appear in the spectrum of the received signal 9, with the peak of closest shunt having the greatest magnitude and smallest frequency shift, and peaks of the most distant shunts having the smallest magnitude and greatest frequency shift. As the locomotive 1 passes over each successive shunt 6, 7, that shunt's spectral peak will disappear from the spectrum 10. The relative magnitudes of the spectral peaks can be used to estimate distances to each successive shunt 6, 7. In this figure, the vehicle is pictured moving to the right, with the track shunts 6, 7 thus located ahead of the vehicle 1, although the system is also capable of operating from a vehicle located on the rear of a train moving in the opposite direction. In such a case, the magnitudes of the spectral peaks would reach a peak as the rear of the train passes over them and decreasing with increasing distance.

Figure 1A:
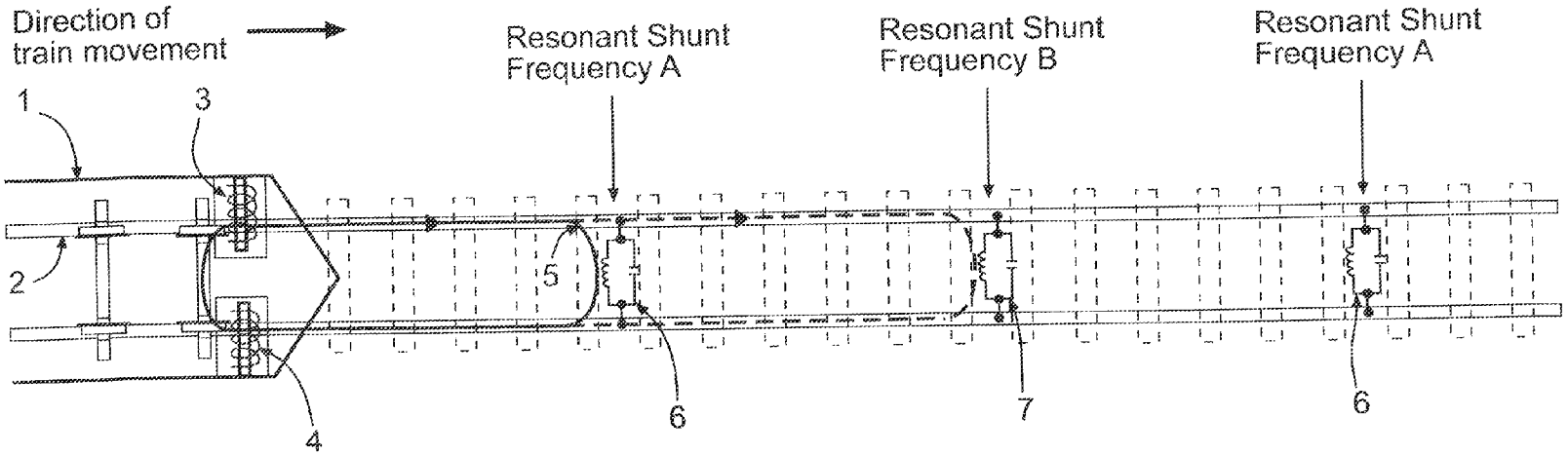
FIG. 1*a* is a pictorial diagram of an embodiment similar to FIG. 1, in which the tuned shunts use parallel LC circuits to provide characteristic notches in their frequency spectra.

In this figure, spectral peaks are shown, each corresponding to the conducting frequency of a shunt 6, 7. In some embodiments, shunts having a high impedance at a predetermined frequency (e.g., a parallel LC circuit) may be used, as shown in FIG. 1*a*. In these embodiments, spectral notches rather than peaks are the electrical signal transmission characteristic associated with each shunt.

Each spectral peak 9, 10, 11, 12, 13 may be shifted somewhat from its nominal position, because the inherent reactance of the track will interact with the reactive elements in the shunt, causing a shift of resonant frequency of that shunt. This concept is further illustrated in FIG. 13. Frequencies of the peaks are compared to the nominal frequencies of the tuned shunts expected to be seen in the locality of the train, obtained from a route database or from the PTC system with GPS coordinates, and the frequencies are subtracted to determine the frequency shifts. Using an impedance model of the track, these frequency shifts are used to estimate distances from the train to each shunt. The relative magnitudes of the spectral peaks are compared, and are also used to estimate the distances to each shunt. Because railroad track behaves as a lossy transmission line, a phase shift will occur between the transmitted and received signals. The degree of this phase shift, as well as knowledge of the inherent impedance the track as a function of position, obtained from a route database, GPS, or other means, or calculated from a track impedance model adjusted for local conditions, can be used, possibly with a Kalman filter or similar algorithm, to estimate the distances to the shunts.

Returning to FIG. 7, as the locomotive 1 approaches a broken rail 8, first the spectral peak associated with the tuned shunt 7, hidden by the break, will disappear from the spectrum 12. In some embodiments, this may cause the control system computer to issue a warning to reduce speed. Finally, the peak associated with the "visible" shunt closest to the rail break 8 will disappear from the spectrum 13 also, as the locomotive passes over it and begins to occupy the same segment of track as the rail break 8. This may cause the control system computer to issue an emergency stop and, in some embodiments, inform the PTC system of a problem in the track 2. The sequence of spectral changes 9, 10, 11, 12, 13 will occur as the locomotive approaches a broken rail 8, and may be used, in some embodiments, to provide an advanced warning as a rail break 8 is approached.

Figure 8:
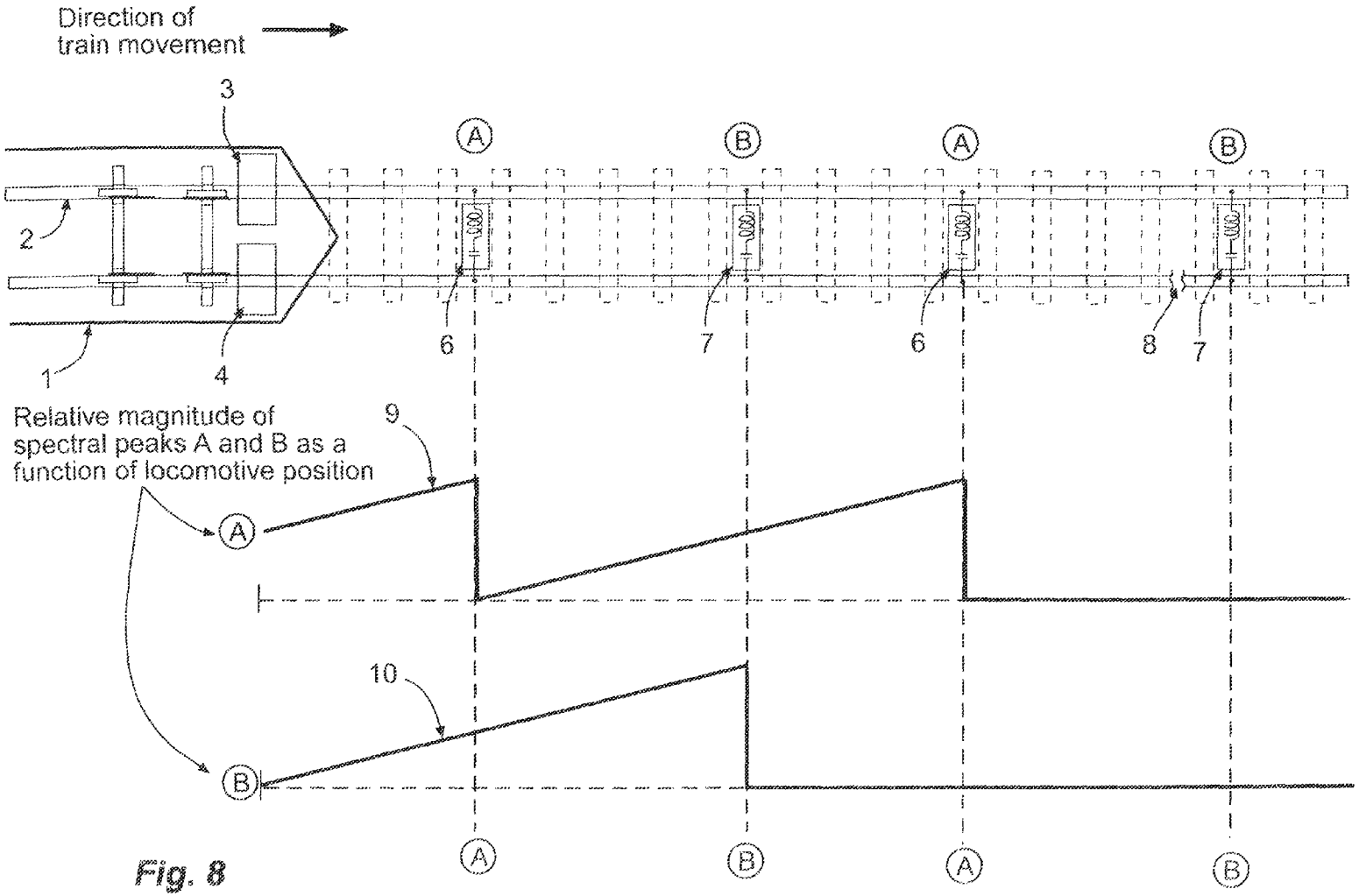
FIG. 8 is a pictorial diagram showing a locomotive traveling on a track, as in FIG. 7, and illustrates how the relative magnitudes of the spectral peaks in the corresponding spectrum at frequencies A and B change as the locomotive moves, eventually approaching the broken rail shown in the figure.

With reference now to FIG. 8, a pattern of spectral changes similar to that illustrated in FIG. 7 is shown. The loss of rail conductivity caused by rail break 8 will produce the same successive pattern and absence of spectral peaks from a distant shunt as was described previously and illustrated in FIG. 7. In FIG. 8, the continuously-variable magnitudes of the spectral peaks 9, 10 produced by shunts "A" 6 and shunts "B" 7 are plotted as functions of locomotive position along the track. The amplitude vs. position waveforms 9, 10 are out-of-phase saw tooth waves. As the locomotive passes the first "B" shunt 7, first the shunt hidden by the rail break 8 disappears from the spectrum plot 10, then the peak caused by the "A" shunt disappears from the spectrum plot 9, as the locomotive 1 occupies the same track segment as the break 8. Note that shunts 6, 7 may be placed in the track where needed, so as to provide as much spatial resolution as desired to maximize track occupancy, and may be selected to have more frequencies than the two used in the illustration. Similar spectral plots can be made for the frequency shifts of the tuned shunts, but such shifts in spectral peaks, and phase shifts, are dependent on local track impedance conditions. Plots of phase shift as function of distance are considerably more complex and depend on several additional parameters, including local conditions of the track.

Figure 9:
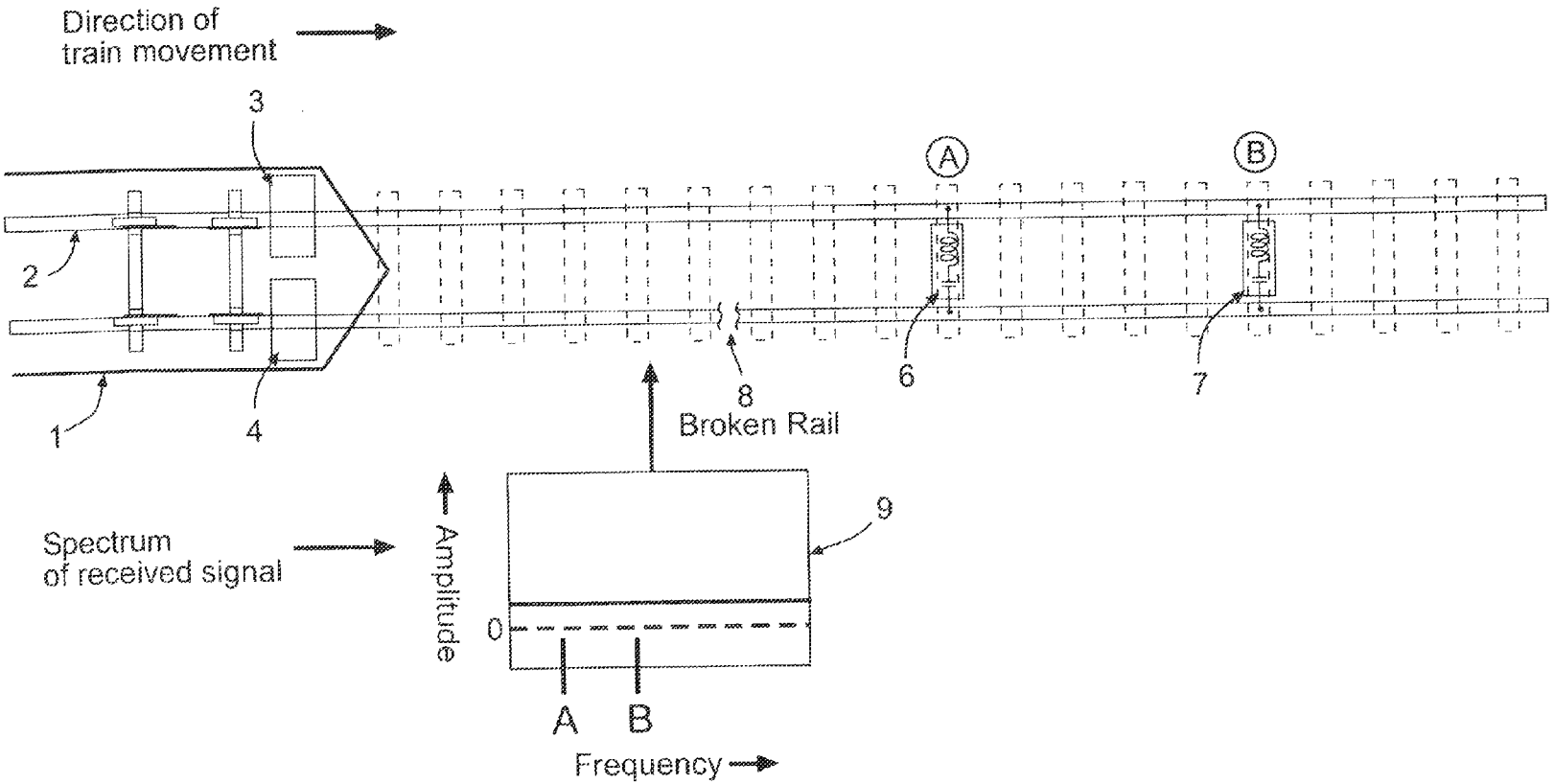
FIG. 9 is a pictorial diagram showing a locomotive traveling on a track, and the spectrum of the corresponding received signal at the locomotive when a broken rail has occurred immediately ahead of the locomotive (i.e., between the locomotive and the next shunt).

With reference to FIG. 9, the spectrum 9 is shown as locomotive 1 approaches an immediate rail break 8, that is, a rail break 8 which occurs between the locomotive and the first shunt 6. The spectrum 9 of the received signal shows no peaks at frequencies A and B, only a noise floor.

Figure 10:
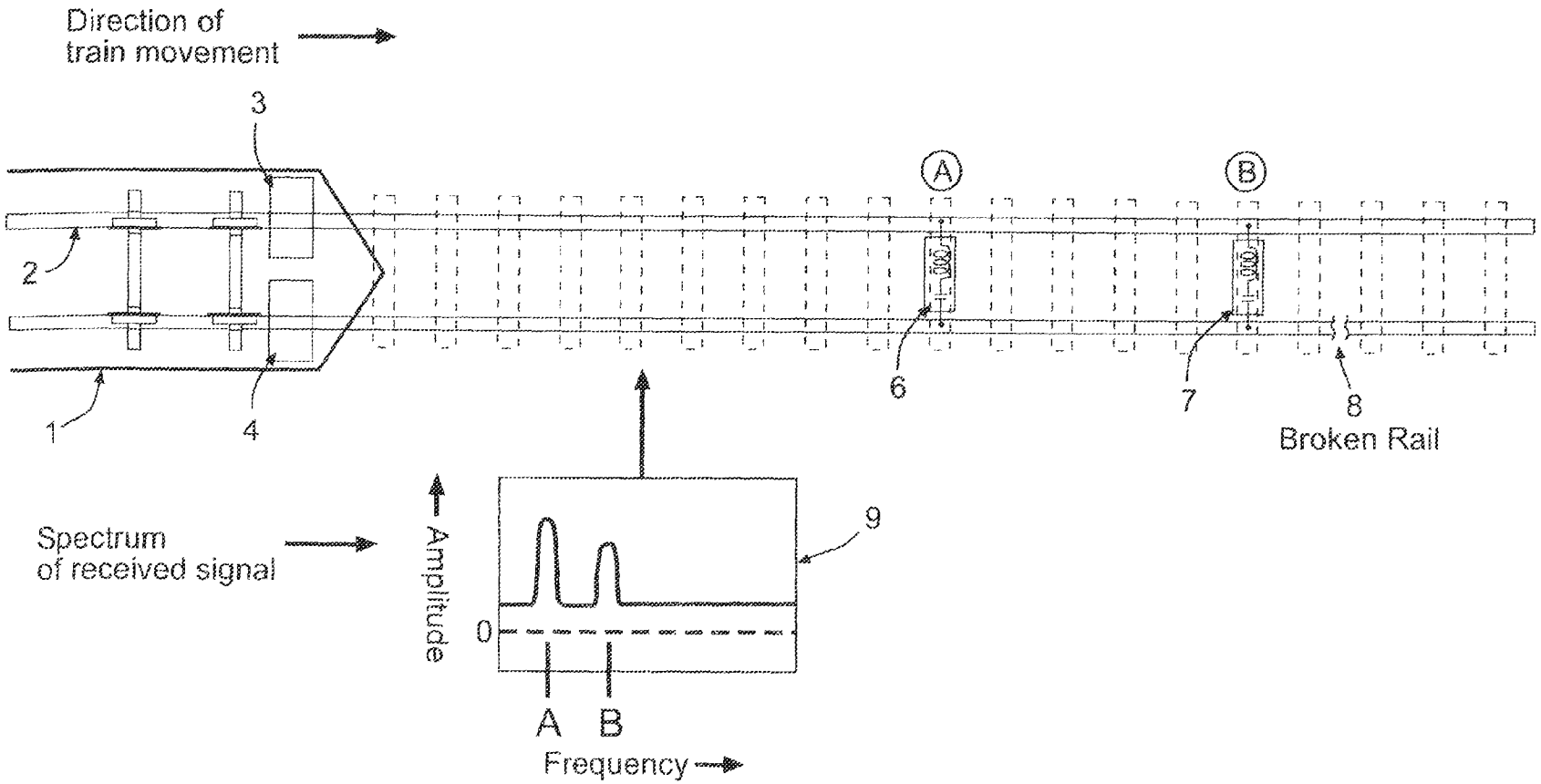
FIG. 10 is a pictorial diagram showing a locomotive traveling on a track and the corresponding spectrum of the received signal at the locomotive when a broken rail has occurred further ahead of the locomotive than is illustrated in FIG. 9 (i.e., with two shunts in the intervening distance).

With reference to FIG. 10, the spectrum 9 is shown that results from a rail break occurring with two shunts 6, 7 between the locomotive 1 and the break 8. The spectrum 9 shows two simple peaks close to nominal frequencies A and B, with a moderate noise floor.

Figure 11:
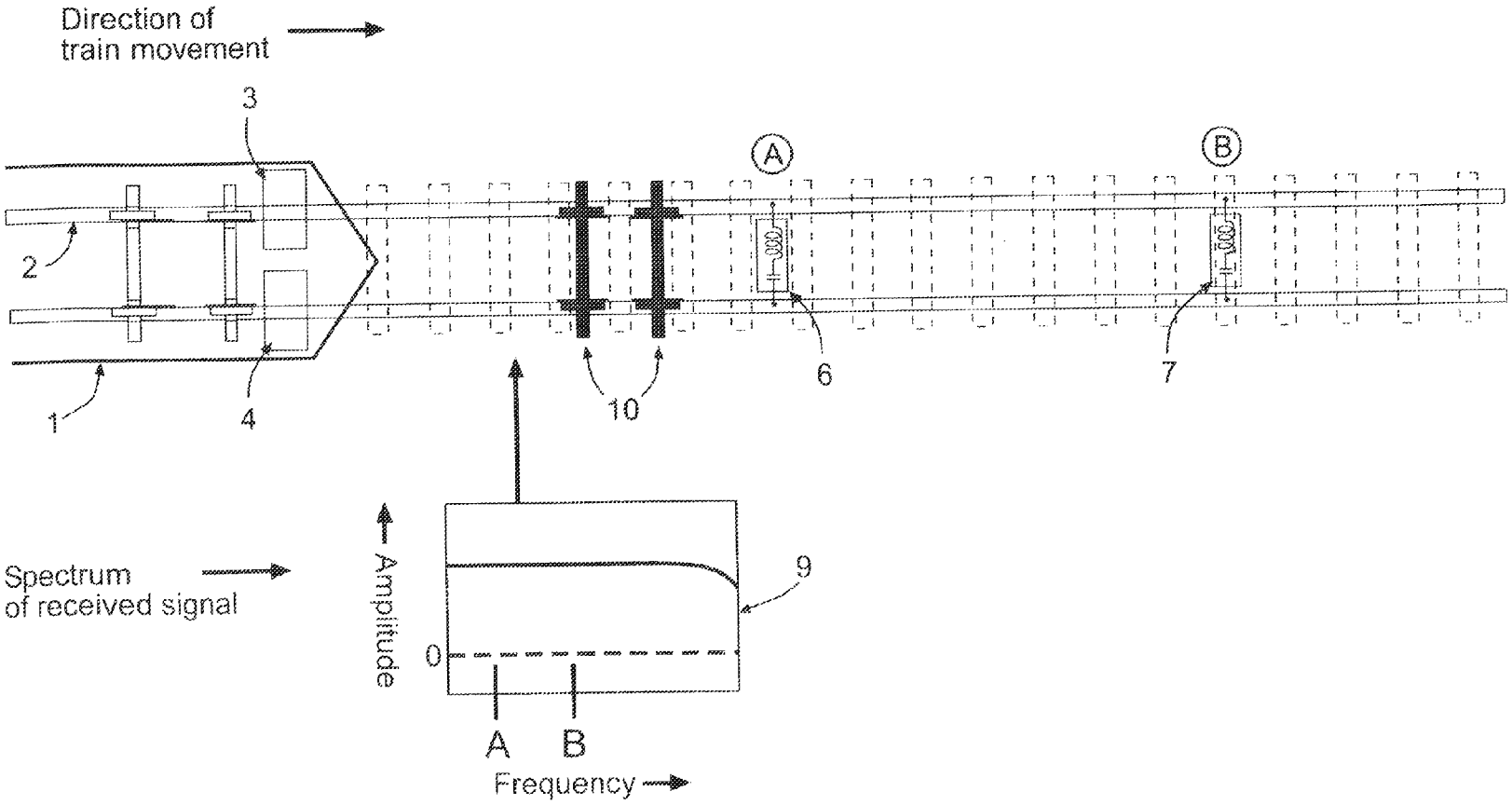
FIG. 11 is a pictorial diagram showing a locomotive traveling on a track and the corresponding spectrum the spectrum of the received signal at the locomotive when a track occupancy occurs immediately ahead of the locomotive (i.e., the occupancy occurs between the locomotive and the next shunt).

With reference to FIG. 11, a situation is illustrated where the locomotive 1 encounters a track occupancy 10 immediately ahead. No peaks are visible in the spectrum 9, but relatively uniform conductivity at all frequencies of interest is shown in the spectrum. Note the roll off in the spectrum at higher frequencies caused by the inherent impedance of the track. The relatively high amplitude and uniform frequency in the spectrum indicates the immediate presence of a track occupancy 10.

Figure 12:
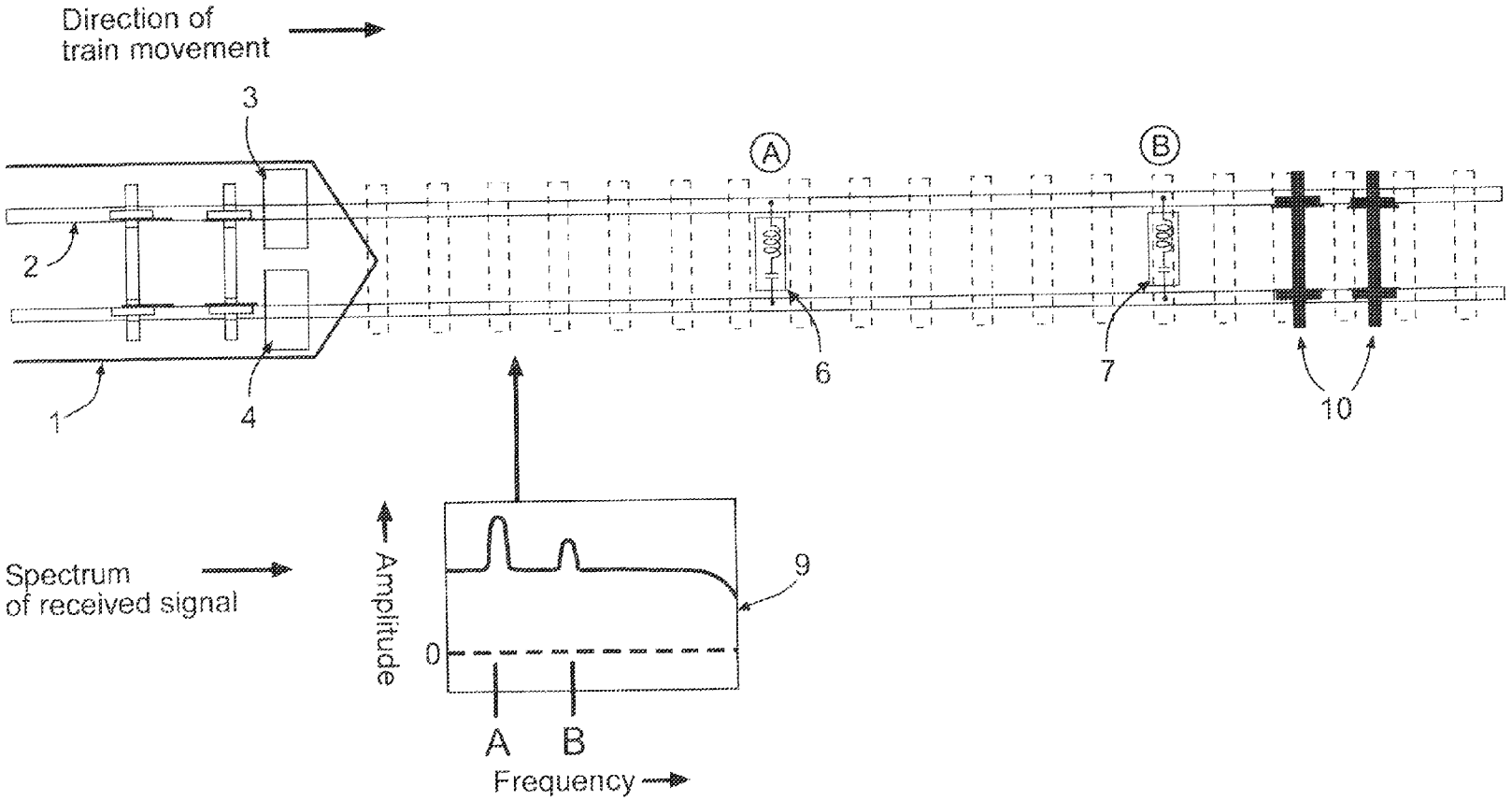
FIG. 12 is a pictorial diagram showing a locomotive traveling on a track and the corresponding spectrum of the received signal at the locomotive when a track occupancy occurs farther ahead of the locomotive than is illustrated in FIG. 11 (i.e., with two successive shunts in the intervening distance).

With reference to FIG. 12, the track occupancy 10 now occurs well ahead of the locomotive 1, with two shunts 6, 7 of alternate frequencies A, B in the intervening distance. The noise floor of the corresponding spectrum 9 is therefore higher than normal, as the occupancy 10 will conduct at all frequencies, but the spectral peaks near frequencies A and B may be partially visible, if conductance at those frequencies is substantially higher than that of the track 2 and track occupancy 10 alone. The high, uniform noise floor indicates to the system that a track occupancy 10 is present, while presence of one or more peaks in the spectrum indicates the presence of intervening shunt(s) 6, 7. In addition, a change in the characteristic impedance of the track 2, caused by the occupancy 10, will cause a change the roll off of the spectrum at higher frequencies.

Figure 13:
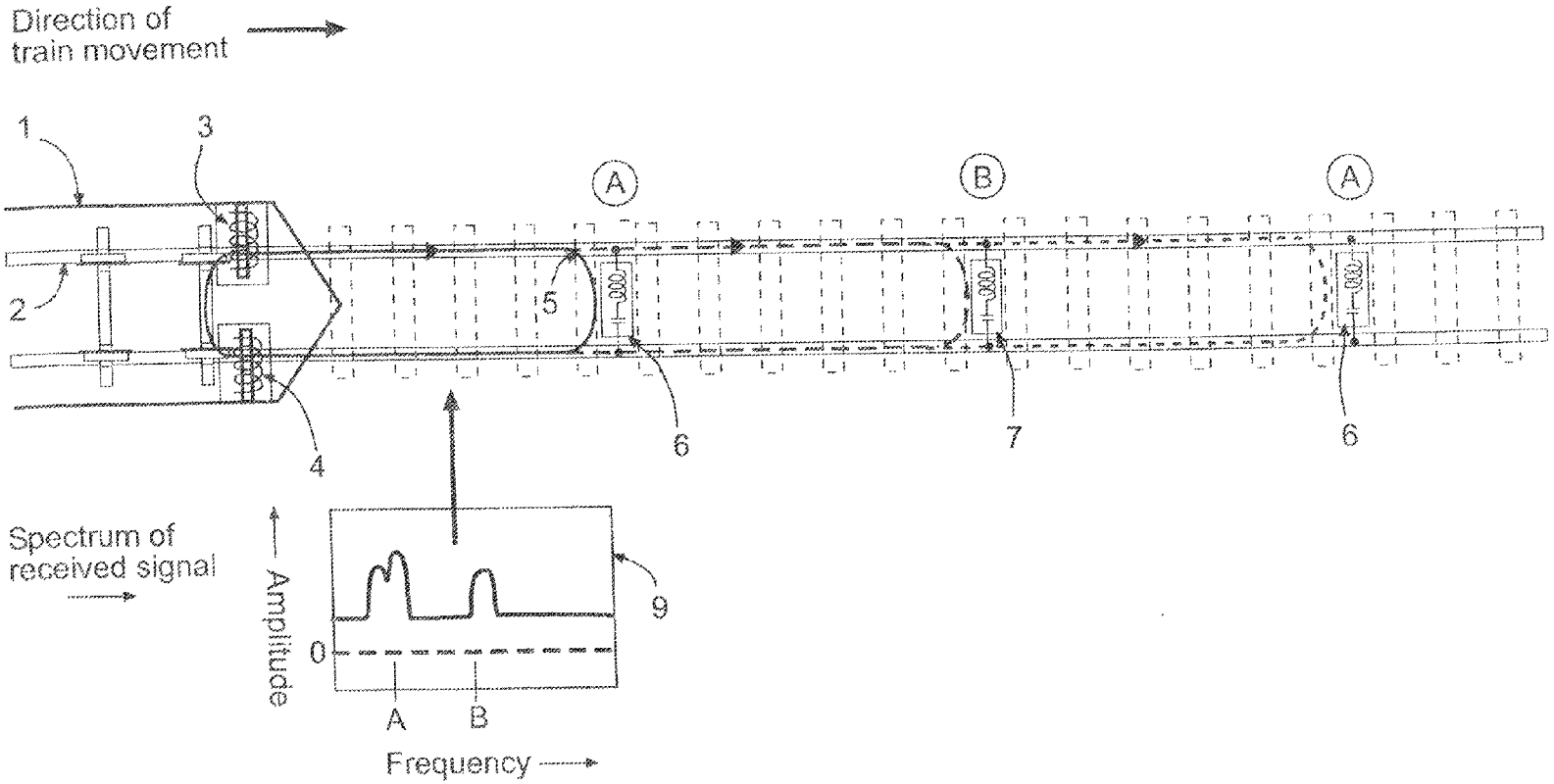
FIG. 13 is a pictorial diagram showing a locomotive traveling on a track and the corresponding spectrum of the received signal under normal track conditions (i.e., where no rail break or track occupancy is encountered) where a portion of the test signal travels through two or more successive shunts of each nominal frequency, causing multiple, shifted peaks to appear in the spectrum of the received signal.

With reference now to FIG. 13, the presence of multiple peaks in the spectrum 9 is shown, because the induced current 5 branches into loops through shunts 6, 7, each loop being formed by relatively long lengths of railroad track 2, which has inherent reactance which interacts with the reactances in the shunts to lower the apparent resonant frequencies of the successive shunts. If the reactance per unit distance of the track is known in advance, or is provided by a route database or train control system, the amount of measured spectral shift can be used by the system to estimate the distance to the shunts 6, 7.

Figure 14:
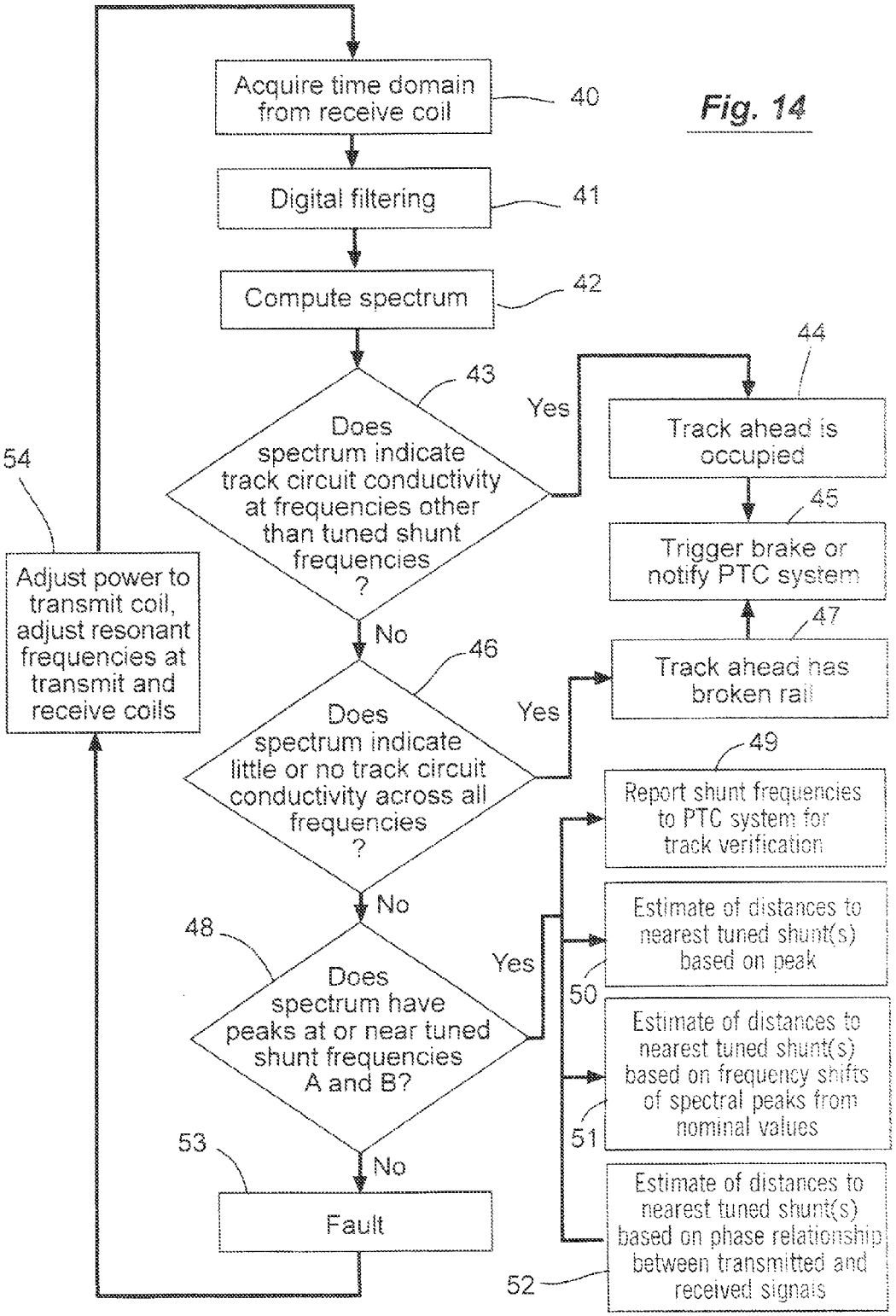
FIG. 14 is a block diagram of a method in accordance with an embodiment of the present invention, in which characteristics of the spectrum of the received signal are interpreted and used to determine the presence or absence of rail breaks or track occupancies ahead of or behind a railway vehicle, and to estimate the distance thereto.

With reference now to FIG. 14, a method in accordance with an embodiment of the present invention is illustrated for detecting rail breaks or track occupancies, and estimating distances to rail breaks, occupancies, or tuned shunts. A pulsed or swept-frequency current is caused to flow in a transmit coil, and time-domain data is collected from a receiving coil (step 40), as has been described previously. The data is filtered (step 41), and its spectrum is computed (step 42). The noise floor of the spectrum is examined, specifically at frequencies other than the shunt frequencies (step 43). If the noise floor is relatively high and uniform, a track occupancy ahead of the train is assumed to exist (step 44), and the train is slowed or stopped, or the train control system is notified (step 45).

If the spectrum shows little or no conductivity at all frequencies (step 46), a broken rail is assumed to exist ahead (step 47), and the train is slowed or stopped, or the train control system is notified (step 45).

If the spectrum is neither uniformly conducting nor uniformly non-conducting, but rather indicates an intermediate level of conductivity and also shows distinct spectral peaks at or near the nominal shunt frequencies (step 48), the relative levels of the spectral peaks and the level of the noise floor is used to estimate the distance(s) to the shunt(s) (step 50). The measured frequencies of the peaks are next compared to the nominal frequencies of the shunts, and the differences (i.e., frequency shifts of the spectral peaks) are found, and knowing the impedance per unit distance of the local track, this difference can be used estimate the distance(s) to the shunt(s) (step 51). The measured shunt frequencies can also be reported to the PTC system for track verification (step 49). Finally, the phase relationship between transmitted and received signals is determined, and, knowing the impedance per unit distance of the local track, in conjunction with a transmission line model of the track, this phase difference is used to estimate the distance(s) to the shunt(s) (step 52). If distinct spectral peaks cannot be found, a fault condition (step 53) is indicated in which the train control system is notified or the train either stops or travels at restricted speed. The power, capacitive shunts, or filtering of the transmitted or received signals are adjusted until a signal is received in step 54, and the process returns to step 40.

In greater detail, referring now to FIG. 6, the control system computer 11, by sweeping or switching the transmitted frequency of the induced track current, and measuring the amplitude, frequency spectrum, resonant frequency shifts or phase information present in the received signal, and further, maximizing the signal-to-noise ratio of the received signal by changing the resonant frequency of the transmit and receive coils by optimally selecting capacitors from a capacitor bank 14 so as to closely match the resonant frequencies of the track circuit or the frequency being transmitted, optimally estimates the distance from the locomotive to the next two resonant, tuned shunts located in the track, by up to three independent means (relative amplitude difference of spectral peaks, frequency shift of spectral peaks, and phase shift of received signal, as the phase shift between transmitted carrier signal and received signal will be cyclically proportional to the distance to each shunt, depending on local track impedance), and, further, provides this information to the train control system, while obtaining GPS location information, expected shunt location information, and local track impedance parameter information from a route database to aid in computation of estimated location. If a broken rail (i.e., open circuit) exists between the locomotive and resonant tuned shunts, the received signal will, as the break is approached, lack frequency components at either transmitted frequency "A", or frequency "B". If an occupied track condition (i.e., short circuit or shunted track condition) exists between the locomotive and tuned shunts, the received signal will contain components of the transmitted frequency (A or B). The control system computer 11 also uses the route database to confirm the locations of shunt-segment boundaries. The control computer 11 will continuously run software that will: (1) update the estimated distance to any potential broken rail or track occupancy; (2) and provide this information to the locomotive operator or a PTC or communication-based train control system; (3) sweep transmitted frequency and compute spectra of received signal; (4) monitor and optimize magnetic coupling between coils and track circuit by adjusting power levels and resonant frequency; (5) adjust optimization algorithm due to changing track conditions, loss of train control communications, loss of GPS data, etc.; (6) determine the optimal spectral baseline by computing a secular moving average or by other technique, thereby reducing interference and the effects of stray coupling to the receive coil on system performance, etc. Note that if the shunts along the track are implemented as frequency notch filters (as shown in FIG. 1*a*) rather than bandpass filters (as shown in FIG. 1), the examples of spectra provided in the figures would show notches rather than peaks at the tuned frequencies.

In another embodiment, the present invention is capable of working interactively with a similar unit affixed to the other end of the train. This would allow detection of rail breaks, occupancies, or open switches behind the train.

In yet another embodiment, the transmit and receive coil functions are functionally combined into a single coil or multiple coils, electrically connected, and respectively placed over each rail, to increase the magnitude of induced current in the track circuit, while the received signal is measured as an impedance change in the combined coils or in a transformer connected to the coils, with a Hall Effect sensor, or by other means or by a combination of these methods. (Note that a coil placed above a closed, tuned track circuit is, in fact, a loosely-coupled transformer, whose primary winding is a single-turn loop formed by the rails, axles, and tuned shunt; therefore, a change in impedance in the primary winding of this transformer should be measurable in the secondary windings on the coil itself.)

In yet another embodiment, a Kalman filter, particle filter, or variant thereof, or other estimation algorithm, is used in the control computer to optimally estimate various parameters, distances, etc.

In yet another embodiment, one or more Hall Effect sensors, or an array of Hall Effect sensors, are used to sense current in the track circuit instead of a receive coil.

In yet another embodiment, one or more Hall Effect sensors are used to sense magnetic interference directly coupled from the transmit coil to the receive coil, which may then be filtered from the received signal by the control system computer. Hall sensors may similarly be used to detect and compensate for other ambient magnetic interference present on the locomotive environment (traction motors, generator, etc.).

In yet another embodiment, a flat coil of relatively large area, oriented directly over the track, or wound and oriented in such a way that its magnetic flux would cut through the circuit formed by the rails and leading axle, may be used to perform the transmit or receive functions.

In yet another embodiment, a toroidal coil (current transformer) may be placed around one of the locomotive axles for the receiver, for better coupling and improved rejection of common-mode magnetically-coupled interference.

In yet another embodiment, shunts of more than two distinct frequencies may be used. Use of multiple frequency shunts is expected to give better detection and shunt differentiation especially in territory where distances between shunts is short. In this and similar embodiments, information in the route database could cause the system to switch to alternate or multiple frequency shunt operation.

In yet another embodiment, active or passive shunts (e.g., transponders or non-linear devices) can be employed where transmission from the shunts may be at different carrier frequencies than are transmitted from the test unit on the locomotive. The test unit can then identify each shunt by its characteristic frequency.

In yet another embodiment, active (powered), amplifying shunts may be used, powered by wayside power, to amplify the test signal at a characteristic frequency for the shunt.

In yet another embodiment, active or passive coded shunts that transmit pulsed binary information may be used. In such an embodiment, the control system computer or route database would process the received binary codes as a way of uniquely identifying each shunt, thereby verifying system operation. Similarly, transponders may be associated with each shunt location, and the route database may contain a lookup table of transponder codes, which information would be used to positively identify each shunt.

In yet another embodiment, the control system computer causes a signal containing noise (e.g., pseudo-random noise) to be coupled to the track circuit, obviating the need for swept or alternating frequency. Frequency sweeping may be preferred to frequency hopping, as the resonant peaks will shift because of interactions of the tuned shunts with track impedance, and thus at least some variation in the transmitted frequency in and around the nominal shunt frequencies is necessary. The control system computer may be used to directly generate the desired transmit signal, rather than an external oscillator, and feed the signal directly to the power amplifier.

In yet another embodiment, the system continuously estimates train speed by monitoring rates of change of spectral peak frequency amplitude shift, phase shift, or timing between shunt detection, and comparing speed thus estimated to GPS or tachometer speed, possibly as a check on system performance.

In yet another embodiment, Barker Codes or other digital or analog low-frequency waveforms are superimposed on the transmitted signal. Such coding schemes can be used to modulate the transmitted carrier to reduce spurious interference and allow better identification of the received signal.

In yet another embodiment, the system is equipped with means to null out direct electromagnetic coupling between the transmit coil and the receive coil, whereby frequencies not used by the shunts are transmitted, and received, to determine the level and phase relation of the directly-coupled signal, and this information is used to modify subsequent received signals to eliminate direct interference.

In yet another embodiment, active transponding shunts are placed in the track, where such shunts respond by transmitting a digital sequence only when they receive particular digital codes modulated on the carrier wave sent by the transmitting coil.

In yet another embodiment, relay-operated devices or the electrical equivalent thereof are placed across the track in place of tuned shunts, and operate in such a manner that when activated by a test signal (e.g., that is a rectified and filtered voltage) induced in the track, cause the rails to alternate between a shunted state and an open state, with each state having a characteristic time period. The onboard system's receiving coil senses this shunting of the rails (e.g., by detecting the drop in current in the track as the relay opens). The onboard system can then identify the track device by its characteristic time period. Use of such track devices in this embodiment would not necessarily require frequency-specific shunts, as the characteristic time constant of these devices can be used to distinguish them or the resulting interrupted wave pattern they produce.

While the invention has been described in terms of various specific embodiments, those skilled in the art will recognize that the invention can be practiced with variations and modifications within the spirit and scope of these claims. The invention should not be limited by the embodiments described above, but by all embodiments and methods within the scope and spirit of the invention.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A method for testing conditions on a railroad track having parallel first and second rails, said method comprising:

providing a plurality of shunts between the first and second rails at intervals along the railroad track, each shunt having at least one characteristic resonant frequency differing from those of adjacent shunts;

providing a test unit on a railway vehicle on the railroad track;

transmitting an electrical test signal from the test unit to the first rail to create a track circuit in which the test signal propagates along the first rail, through at least one of the shunts, returns to the railway vehicle along the second rail and through the wheels and axle of the railway vehicle; said test signal having predetermined electrical properties selected to interact with at least one of the shunts;

receiving the test signal from the second rail at the test unit; and analyzing the received test signal to identify at least one predetermined condition concerning the status of the railroad track.

2. The method of claim 1 wherein the received test signal is analyzed in the frequency domain to identify said conditions.

3. The method of claim 2 wherein the received test signal is analyzed in the frequency domain for peaks/notches corresponding to the resonant frequencies.

4. The method of claim 1 wherein the frequency of the test signal is adjusted to match the resonant frequency of at least one of the shunts.

5. The method of claim 1 wherein the frequency of the test signal is swept over a range of frequencies encompassing the range of resonant frequencies of the shunts.

6. The method of claim 1 wherein the test signal is pulsed.

7. The method of claim 1 wherein the identified condition is the presence of a track discontinuity indicated by the absence of a received test signal at one of the resonant frequencies of a shunt in the vicinity of the railway vehicle.

8. The method of claim 1 wherein the identified condition is the occupancy of the railroad track by another railway vehicle, indicated by the presence in the received test signal of substantially all frequencies in the test signal.

9. The method of claim 1 wherein the identified condition is the distance from the railway vehicle to the next shunt along the railroad track, indicated by measuring the relative amplitude of the received test signal at the resonant frequency of the next shunt.

10. The method of claim 1 wherein the identified condition is the distance from the railway vehicle to the next shunt along the railroad track, indicated by measuring the frequency shift of the spectral peak in the received test signal associated with the resonant frequency of the next shunt relative to its nominal value.

11. The method of claim 1 wherein the identified condition is the distance from the railway vehicle to the next shunt along the railroad track, indicated by measuring the phase shift of the spectral peak of the received test signal with respect to the transmitted signal, associated with the resonant frequency of the next shunt.

12. The method of claim 1 wherein the test signal is transmitted to the first rail by a transmit coil inductively coupled to the first rail.

13. The method of claim 1 wherein the test signal is received from the second rail by a receive coil inductively coupled to the second rail.

14. The method of claim 1 wherein the test signal is received by detecting current in the second rail via a Hall Effect sensor on the railway vehicle near the second rail.

15. The method of claim 1 wherein at least one of the shunts is powered to amplify the test signal at a characteristic frequency for the shunt.

16. The method of claim 1 wherein at least one of the shunts encodes the test signal with data identifying the shunt, and wherein the test unit decodes the identifying data from the received test signal.

17. The method of claim 1 wherein at least one of the shunts responds at a different frequency than are transmitted from the test unit, and wherein the test unit identifies the shunt by the characteristic frequency for the shunt.

* * * * *